US008453282B2

(12) United States Patent
Vrzalik et al.

(10) Patent No.: US 8,453,282 B2
(45) **Date of Patent: *Jun. 4, 2013**

(54) PATIENT SUPPORT APPARATUS

(75) Inventors: John H. Vrzalik, San Antonio, TX (US); Bruce Phillips, San Antonio, TX (US); Cesar Lina, Universal City, TX (US)

(73) Assignee: Huntleigh Technology Limited, Bedfordshire (GB)

( * ) Notice: Subject to any disclaimer, the term of this patent is extended or adjusted under 35 U.S.C. 154(b) by 1127 days.

This patent is subject to a terminal disclaimer.

(21) Appl. No.: 11/848,756

(22) Filed: Aug. 31, 2007

(65) Prior Publication Data

US 2008/0047565 A1 Feb. 28, 2008

Related U.S. Application Data

(63) Continuation of application No. 10/869,121, filed on Jun. 16, 2004.

(51) Int. Cl.
*A47B 7/02* (2006.01)

(52) U.S. Cl.
USPC ..... 5/603; 5/607

(58) Field of Classification Search
USPC ..... 5/607, 609, 629, 11, 611
See application file for complete search history.

(56) References Cited

U.S. PATENT DOCUMENTS 4,650,018 A * 3/1987 Silverman, Sr. ..... 180/14.7
2002/0138906 A1 * 10/2002 Bartlett et al. ..... 5/609

* cited by examiner

*Primary Examiner* — William Kelleher
*Assistant Examiner* — Richard G Davis
(74) *Attorney, Agent, or Firm* — Fulbright & Jaworski L.L.P.

(57) ABSTRACT

A patient support system particularly suited for pediatric twin separation surgery. The patient support system includes a frame coupled to a swing circle that has a plurality of holes about the perimeter. A patient support structure is coupled to the swing circle, and disposed in a fixed relationship to the frame after rotation of the swing circle relative to the frame. A chain-and-sprocket mechanism is coupled to the frame and swing circle and positioned within the frame. At least one support leg depends from the frame, and may extend or retract relative to the frame. A drape cage is coupled to the frame for supporting a surgical drape thereon. At least one support wheel is connected to the support leg, and adapted to be interchangeably fixed in a static position and rotatable to move the frame. A substantially identical second frame may be connected in series to the frame for operative procedures.

13 Claims, 5 Drawing Sheets

PATIENT SUPPORT APPARATUS

CROSS REFERENCE TO RELATED APPLICATIONS

This application is a continuation of U.S. Ser. No. 10/869,121, filed Jun. 16, 2004, entitled "Patient Support Apparatus", the entire content of which is incorporated herein by reference.

BACKGROUND OF THE INVENTION

1. Field of the Invention

The present invention relates generally to patient support apparatus and more particularly but not by way of limitation, to a pediatric support surface system that provides convenient accessibility during operative procedures.

2. Description of the Related Art

Developing technology has made surgical procedures more complex. Miniaturization of operating tools, magnetic resonance, microscopic efficiency, and other advances enable doctors to fix problems today using procedures that were inconceivable 20 years ago. The advances in tools utilized by doctors now require certain formerly inaccessible areas of patients to be accessible.

An example of one procedure that has undergone tremendous changes is the separation of conjoined twins. Operations on conjoined twins can now be performed in what was once considered as impossible. Conjoined twins history has been recorded, and oftentimes the history involves death when separation is attempted.

One of the earliest recorded examples of conjoined twins was a set of identical twins in 945 A.D. in Constantinople connected from the waist to the abdomen. An attempted surgical separation of the twins caused the death of one, with the survivor dying three days later.

Perhaps the best-known set of twins was Chang and Eng, who were born on a houseboat in the village of Mekong, in what was formerly known as Siam on May 11, 1811. Chang and Eng were the first given the name "Siamese Twins". These twins lived a relatively long life, and together fathered 21 children with their respective wife. They were never surgically separated.

Craniopagus-conjoined twins—those joined at the head—are rare. Despite the rarity, surgical separation of these twins has been attempted, both successfully and unsuccessfully. Recently, 29-year-old craniopagus-conjoined twins Ladan and Laleh Bijani of Iran died from blood losses in the brain shortly after doctors apparently successfully separated their two skulls. Their chances of survival entering the operation were perceived to be no better than 50-50. It is believed that the Bijani Twins were only the second set of adult conjoined twins to be separated in recorded history. The first were the Godino brothers, but they were only separated after one died. The other died a few days later of infection. The Godino brothers were 28 at the time of their separation.

More recently, craniopagus-conjoined twin boys Ahmed and Mohammed Ibrahim Mohammed were born Jun. 2, 2001 in the southern Egyptian town of Qus connected at the skull and brain. The boys were flown to Dallas, Tex. for separation surgery in what made headlines throughout the United States, and world. After several delays, the successful 34-hour surgery took place on Oct. 12-13, 2003.

One of the problems of such surgeries is the support surface, or operating table, utilized by doctors must be accessible in a large arcuate range, so that the many complex tools required can be accessible by the doctors during such procedures. Unfortunately, due to the rarity of such surgeries, support surface technology has not caught up with operation technology, and oftentimes special devices must be designed to meet the needs. And because the conjoined twins are often separated at pediatric stages, such support surface technology must be so modified.

Accordingly, there is a need to provide a support surface system for pediatric surgical procedures, particularly for separating craniopagus-conjoined twins, capable to be used as an operating table providing sufficient access to doctors during the surgical procedure, and that minimizes doctor-movement requirements and provides access to the patient.

BRIEF SUMMARY OF THE INVENTION

The present invention fulfills these and other needs through the development of a patient support surface system adapted to perform under surgical operating procedures. A first support surface, adapted to be connected in series with a second support surface, is provided. The first and second support surfaces are preferably symmetrical, and are rotatably coupled to a respective support frame. The support surfaces are adapted to rotate in relation to one another on a common axis, and may be fixed in relation to one another. One or more adjustable spacers are provided to couple the support frames. The spacers may be adjusted to provide more or less area between the support frames when patients are resting on a respective support surface.

Support wheels are coupled to the frames and adapted to support the frames in a fixed or mobile position. The height of the frames and support surfaces may be adjusted hydraulically, manually or other suitable means by extending or retracting legs coupled to the frame body. In this manner, the legs may be adjusted to create a Trendelenburg/reverse-Trendelenburg position, or to raise or lower the frames and support surfaces.

Accordingly, the present invention provides sufficient area between conjoined patients to allow doctors to operate, and provides sufficient rotational capabilities and Trendelenburg capabilities to adjust the angle and or height of one patient with respect to another.

BRIEF DESCRIPTION OF THE SEVERAL VIEWS OF THE DRAWING

A more complete understanding of the method and apparatus of the present invention may be obtained by reference to the following Detailed Description of the Invention, with like reference numerals denoting like elements, when taken in conjunction with the accompanying Drawings wherein.

DETAILED DESCRIPTION OF THE INVENTION

The present invention provides a mobile and conveniently accessible operating surface for the separation of conjoined twins using a heretofore-unavailable operating surface.

Figure 1:
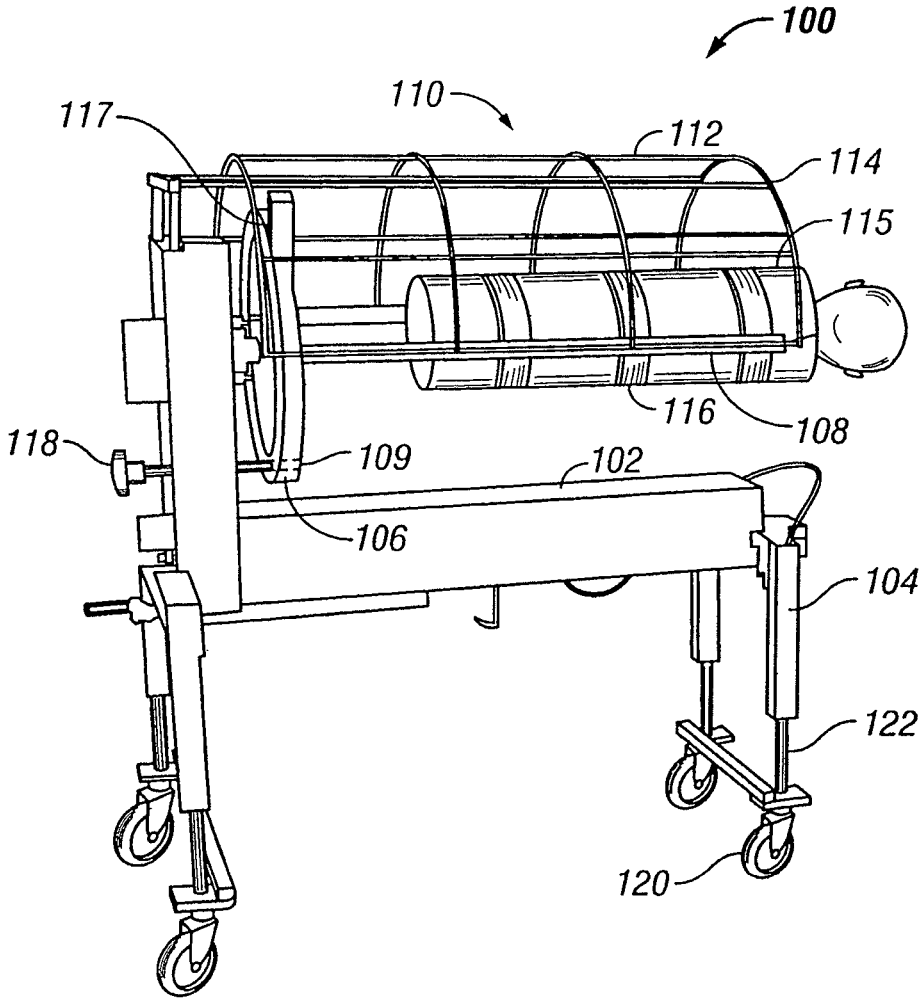
FIG. 1 is an exemplary side plan view of a patient support system in accordance with one embodiment of the present invention.

Referring first to FIG. 1, a patient support system 100 is shown. The patient support system 100 includes a frame 102 having a plurality of legs 104 depending therefrom. A swing circle 106 is axially coupled to one end of the frame 102 on one side, and is coupled about its perimeter to a U-shaped frame 108 on the opposite side. The swing circle 106 is adapted to rotate about its axis in a predetermined angle with respect to the frame 102, and includes a plurality of holes 109 about its perimeter.

A removable cage 110 is connected to an upper portion of the frame 102, and extends longitudinally outward from the frame 102 and above the U-shaped frame 108. The removable cage 110 includes at least one longitudinal support 112, and a plurality of semicircular arcs 114 depending therefrom and equally spaced along the length of the longitudinal support 112, which provide a support surface for surgical drapes or the like during operative procedures. Additional longitudinal supports 112 may be included and spaced along the arcs 114 as needed.

The U-shaped frame 108, which is adapted to support a support surface structure 115 there between, is connected to the support surface structure 115 via a plurality of support surface straps 116. The U-shaped frame 108 further includes a support member 117 perpendicular to the U-shaped frame 108 coupled to the swing circle 106 on the perimeter of the swing circle 106. The U-shaped frame 108 is adapted to be gripped by a user and rotated a predetermined angle to adjust the support surface structure 115 as needed. The U-shaped frame 108 and swing circle 106 are adapted to be fixed in a position relative to the frame 102 by a locking pin 118, which extends through the frame 102 and into a hole 109 on the swing circle 106.

Each leg 104 is adapted to connect to a support wheel 120 for movement of the frame 102 relative to a surface. The wheels 120 are adapted to extend or retract relative to the leg 104, and may be hydraulically controlled through hydraulic adjustment of wheel shafts 122 positioned within a respective leg 104. The wheels 120 are further adapted to lock in a static position to prevent undesirable movement of the patient support system 100. A suitable wheel 120 would be a caster or the like. A hydraulic cylinder (not shown) may be included within the frame 102 for controlling the extension or retraction of the wheel shafts 122. As such, the frame 102 may be positioned to place the patient in a Trendelenburg/reverse-Trendelenburg position or to otherwise shift positions relative to the surface during operative procedures on a patient.

Figure 2:
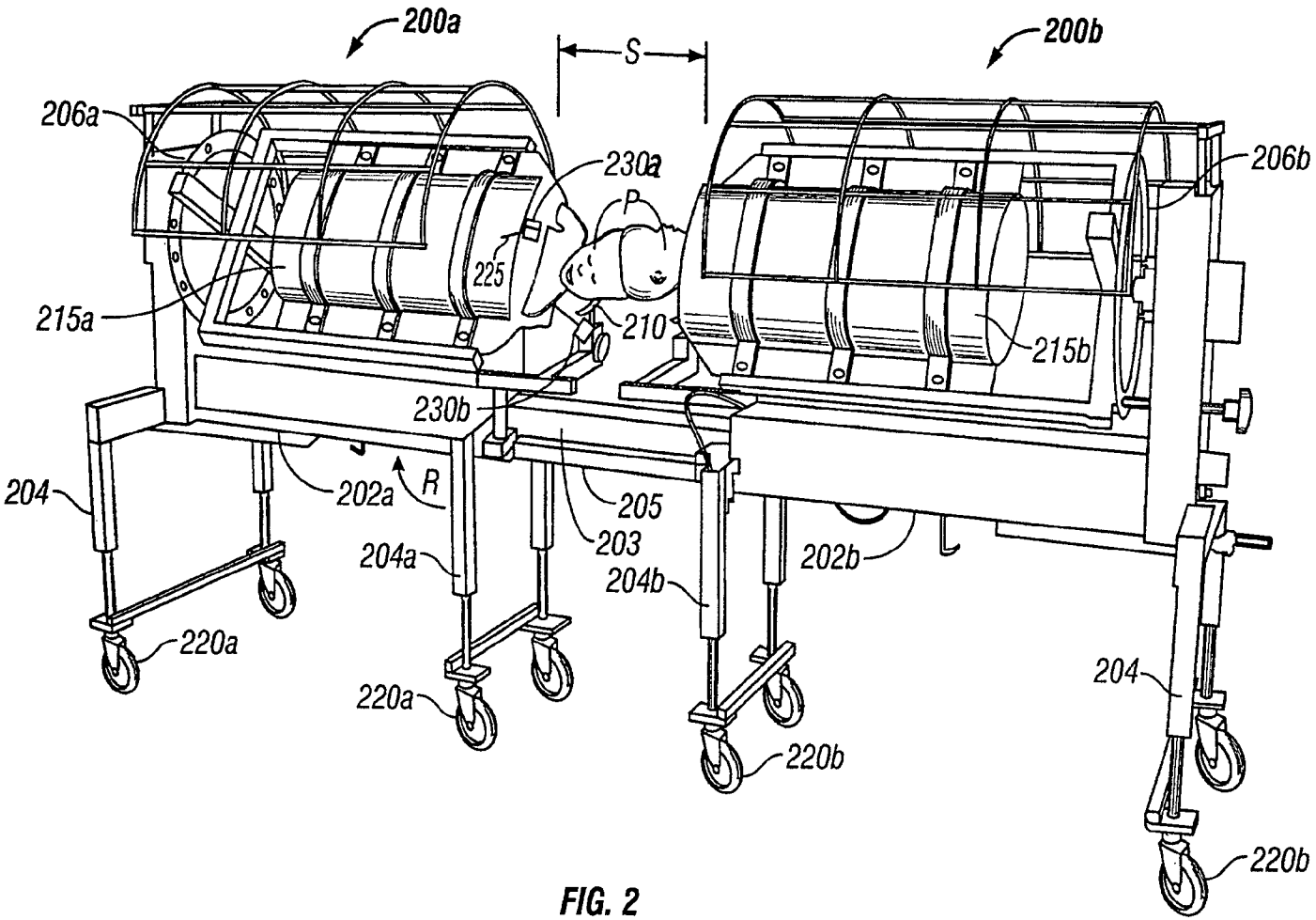
FIG. 2 is a side plan view of two patient support systems connected in series in an exemplary configuration.

Referring now to FIG. 2, two patient support systems 200*a*, 200*b* are shown connected in series via at least one adjustable spacer 205. In this configuration, it can be appreciated that sufficient space S is provided between opposing support systems 200*a*, 200*b* to allow doctors and other medical personnel access to patients P. In addition, the spacer 205 may comprise two spacers placed at outside surfaces of the respective support systems 200*a*, 200*b* and having an open area there between, thus allowing medical personnel access to the patient P from underneath the patient P should circumstances require. And depending on the conjoined configuration of the patients, which may vary on a case-by-case basis, the wheels 220*a*, 220*b* may be adjusted to create a Trendelenburg/reverse-Trendelenburg configuration or to otherwise align the patient support systems 200*a*, 200*b*. It is important to note that after the patients have been separated, the support systems 200*a*, 200*b* may be moved to a different location to provide more room for medical personnel.

Both support systems 200*a*, 200*b* are adapted to rotate with respect to another through a common rotation shaft 203 interconnecting the support systems 200*a*, 200*b*. As such, rotation of one system will automatically rotate the other system the same degree of rotation through manipulation of a respective swing circle 206*a*, 206*b*. The rotation shaft 203 may be housed within a suitable housing (not shown) to minimize the effects of any torsional or other entanglement of medical equipment during use of the systems 200*a*, 200*b*.

More specifically and with reference to support system 200*a*, an adjustable head support 210 may be provided to support the head of patient P during surgical procedures. The adjustable head support 210 is connected to the respective support surface structure, such as in this example support surface structure 215*a*, via conventional means, and may be raised or lowered depending on the requirements of the user. In addition, recent technology has allowed surgeons to map out the separation area between patients. Such advances require at least one navigation device 225 to be viewing the patient P in a line of sight to transmit the image of the patient P and the relative position of the surgeon in/on a patient P to a remote viewing device (not shown). The line-of-sight requirements for such devices necessitate a suitable mounting mechanism, such as the one shown in FIG. 2. A pair of diametrically opposed navigation support arms 230*a* and 230*b* are shown attached to the support surface structure 215*a*. The support arms 230*a* and 230*b* may be adjustable, such as lengthened or contracted depending on the requirements of the user.

Still referring to FIG. 2, the respective forward-side legs 204*a* may be adapted to pivot towards the frame 202*a* during surgery as indicated by arrow R to provide more room for surgeons during operative procedures. The remaining non-pivoted legs 204 and the configuration of the support systems 200*a*, 200*b* provide sufficient support to the patient(s) during operation should the forward-side legs 204*a*, 204*b* be pivoted to the respective frame 202*a*, 202*b*.

It is to be appreciated that additional mounting equipment for devices adapted to support the patient's body, such as a halo-type device for fixing the patient's head relative the support surface structure 215*a* and 215*b*, may be connected to the support surface structure 215*a* and 215*b*. Such mounting equipment includes the likes of extendable arms, pivot arms, fixed arms, and other common support devices and are contemplated to be within the scope of the present invention.

Figure 3:
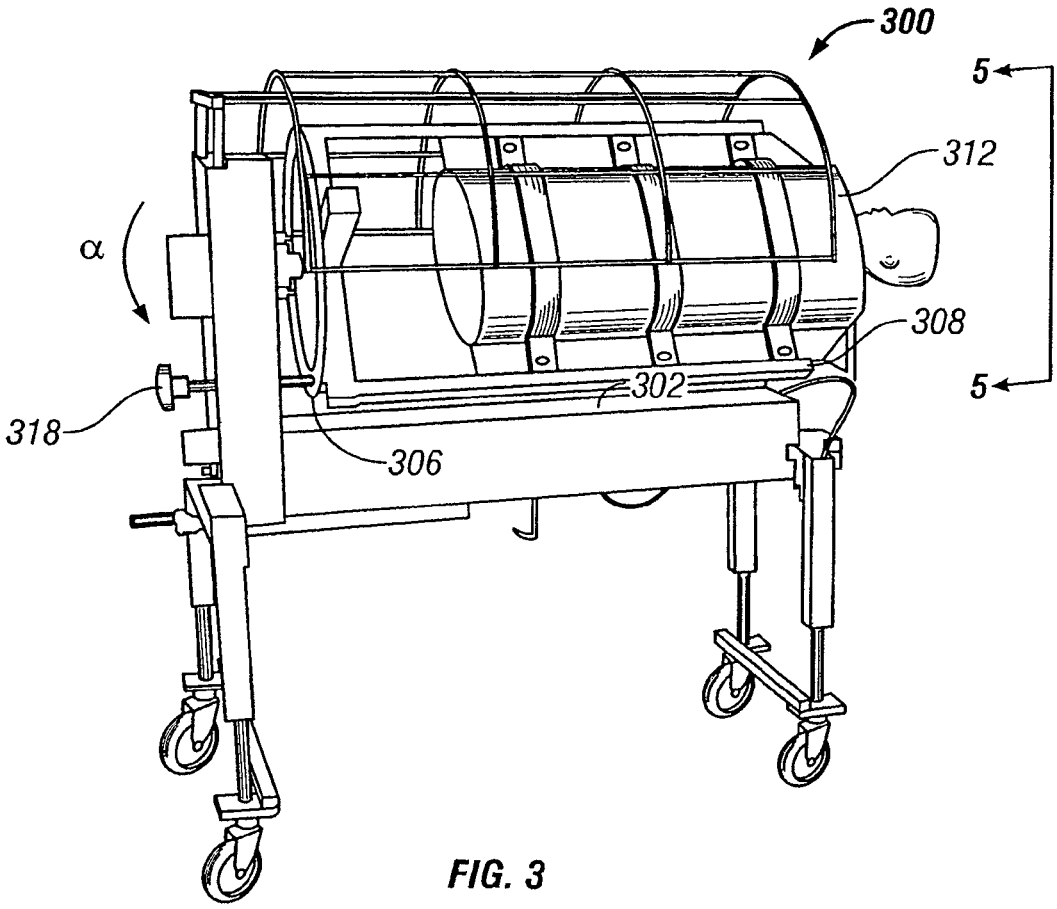
FIG. 3 is a side plan view of the patient support system of FIG. 1 after the support surface has been rotated through a predetermined angle, $\alpha$.

Referring now to FIG. 3, a patient support system 300 is shown in an exemplary configuration. Specifically, the patient support system 300 is shown after the U-shaped frame 308 has been rotated a predetermined angle $\alpha$, to support the patient P in whatever configuration is required based on the separation procedure. To achieve this rotation, the U-shaped frame 308 and swing circle 306 are rotated through the predetermined angle $\alpha$ and the U-shaped frame 308, which supports the support surface structure 312, is locked into position with the locking pin 318 that extends through the frame 302 and swing circle 306, thereby fixing the position of the U-shaped frame 308 and patient support structure 312 relative to the frame 302.

Figure 4:
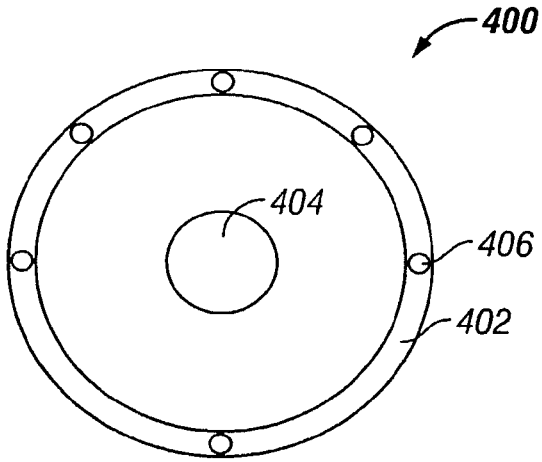
FIG. 4 is an end view of an exemplary swing circle used in the patient support system of FIG. 1.

FIG. 4 is an end view of an exemplary swing circle 400 used in the present invention. The swing circle 400 has a perimeter portion 402 and an axial portion 404. The perimeter portion 402 has a plurality of holes 406 adapted to receive a locking pin (not shown) therethrough to fix the swing circle 400 relative to the frame (not shown). The axial portion 404 connects with the chain-and-sprocket mechanism (FIG. 7) and frame to maintain sufficient resistance during rotation and to stabilize the patient support system (not shown). The number and location of holes 406 about the perimeter of the swing circle 400 may vary, depending on the needs of the user. In addition, the thickness of the swing circle 400 may be varied, as may be required during use.

Figure 5:
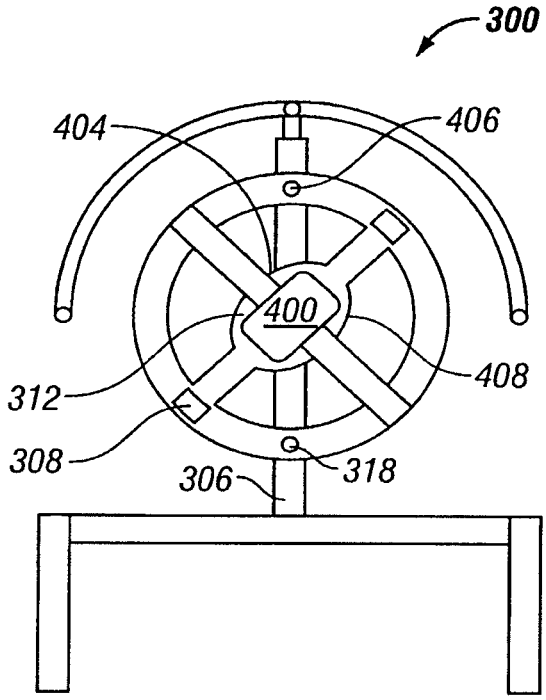
FIG. 5 is an end view of the patient support system taken along line 5-5 of FIG. 3.

FIG. 5 is an end view of the patient support system 300 of FIG. 3, taken along line 5-5 of FIG. 3. It can be appreciated in this view that the patient support structure 312 may comprise an upper portion 404 and a lower portion 408, both upper and lower portions 404, 408 defining an opening 400 there between. The patient P may be supported between the upper and lower portions 404, 408 and extend through the opening 400. In this configuration, the patient support surface 312 is rotated in one exemplary direction, but it is to be appreciated that the patient support system 312 is adaptable to rotation of the support surface through greater angles, up to and including about 180° and greater from the initial configuration of FIG. 1.

It is also desirable to have any tubes, lines or other devices utilized during the surgery to remain orientated away from the separation area. As such, the upper and lower portions 404, 408 may define a second opening (not shown) opposite the opening 400 to allow any surgical lines (such as, for example, those used for anesthesia) to be directed away from the operating area. The second opening may also provide room for the patient P to extend therethrough.

It is further desirable to configure the interior of the upper and lower portions 404, 408 with padding (FIG. 8), such as contoured foam, to provide a comfortable support structure for the patient during operation. Such padding may be adapted to fit the specific contour of the patient and to assist supporting the patient P during surgical procedures.

Figure 8:
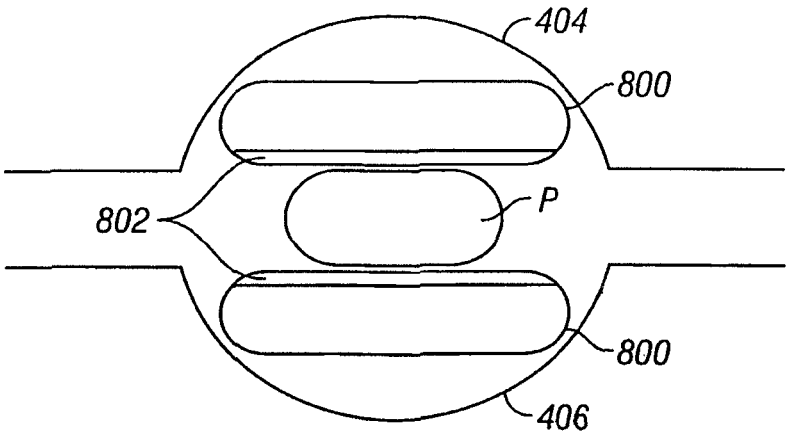
FIG. 8 is an end view of the upper and lower portions of the patient support system.

Additionally, referring to FIG. 8, one or more gas-filled inflatable bladders 800 may be placed within the upper and lower portions 404, 408. These gas-filled bladders 800 are adapted to inflate or deflate to provide comfort and support to a patient P housed between the portions 404, 408. Inflation or deflation of these gas-filled bladders 800 may be done via manual or automatic means, depending on the requirements of the user. For example, when a patient P needs to be rotated, the gas-filled bladders will inflate during rotation, and the bladder on the chest-facing side of the patient P will partially deflate to provide breathing room for the patient P. Padding 802 may be provided on the bladders 800 or in other areas between the upper and lower portions 404, 408 as circumstances dictate.

Figure 6:
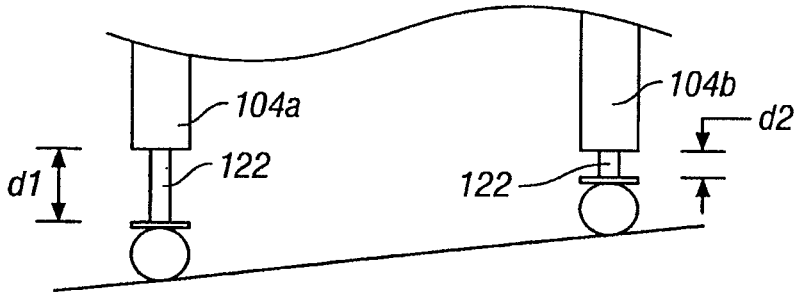
FIG. 6 is a side plan view of a lower portion of the patient support system of FIG. 1 after the wheels have been adjusted to provide an Trendelenburg/reverse-Trendelenburg position of a patient on the support surface.

Referring now to FIG. 6, a partial side plan view of the patient support system 100 is shown in an exemplary configuration. More particularly, support legs 104*a*, 104*b* of the patient support system 100 are shown extended and retracted from original configurations. For example, support leg 104*a* is shown extended distance d1, whereas support leg 104*b* is retracted distance d2. In this configuration, the support system may be moved into a Trendelenburg/reverse-Trendelenburg configuration, depending on the orientation of the support surface structure.

Configuration of the wheel shafts 122 may be controlled manually or through the use of a hydraulic cylinder (not shown) in the frame (FIG. 1), with appropriate control devices available on the frame itself. Such a mechanism is available depending on the requirements of the user, and provides for convenient raising or lowering of the system in addition to the Trendelenburg properties.

Figure 7:
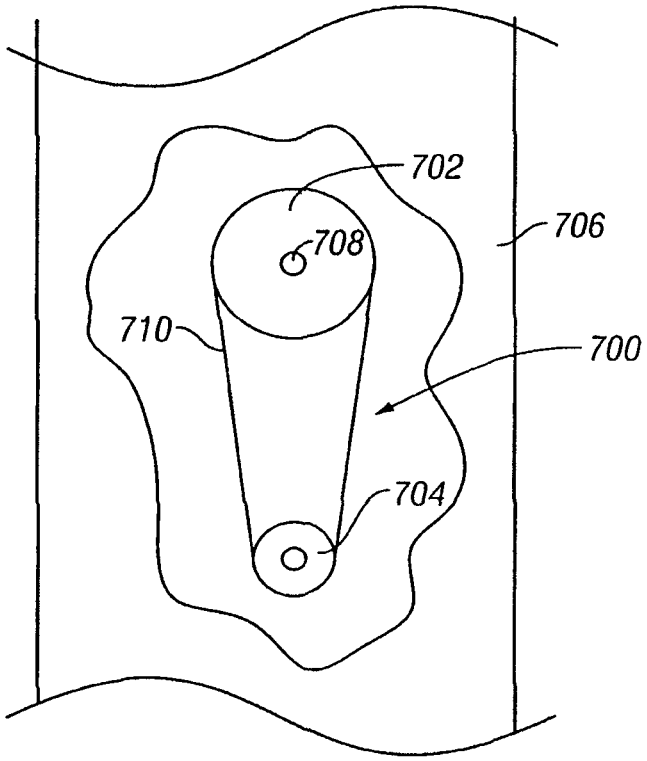
FIG. 7 is a partial cross section view of a support frame having an exemplary chain-and-sprocket mechanism.

FIG. 7 is a partial cross section view of a support frame 706 having an exemplary chain-and-sprocket mechanism 700 used in accordance with the principles of the present invention. Preferably, the chain-and-sprocket mechanism 700 comprises first sprocket 702 and second sprocket 704, which are connected to the support frame 706. First sprocket 702 includes axial shaft 708, which is connected to the U-shaped frame (not shown in this FIGURE). The sprockets 702, 704 are connected via chain 710, and rotate with respect to swing circle rotation. The rotation ratio between the sprockets 702, 704 may be adjusted to meet the requirements of the user, such that the resistance of rotation can be controlled. It is important to note that when the support frame 706 is connected to another support frame (not shown), the same rotation ratio must be used on both frames so that the frames will rotate at exactly the same rate and remain synchronous.

In use, the patients are secured to a respective patient support apparatus in a predetermined position. If necessary, the patient support surfaces are tilted at a predetermined angle through rotation of the swing circle, which is then fixed in position through the locking pin. The patient support systems are adjusted for placement of the patient in a Trendelenburg/reverse-Trendelenburg orientation, or other alignment, and the patients are further prepared for surgery. During surgery of conjoined patients, for example, the angles of the patients relative to one another stay exactly the same due to the relative joining of the patients, but can be adjusted through rotation and fixation of the respective swing circle after separation. Upon separation, the support systems may be separated and rolled away via the wheels to an open configuration to allow surgeons to finish the surgery.

While particularly suited for craniopagus-conjoined twin separation, it is to be appreciated that the patient support system may also be used on single patients. The rotatable operating surface provided by the present invention and its resulting benefits are attractive, easily maneuverable and readily adjustable. In addition, patients conjoined in other positions may appreciate the benefits of this invention.

The previous description is of preferred embodiments for implementing the invention, and the scope of the invention should not necessarily be limited by this description. The scope of the present invention is instead defined by the following claims.

We claim:

1. A support system comprising:
a first frame;
a plurality of legs depending from the first frame;
a swing circle coupled to the first frame;
a U-shaped frame coupled to the swing circle;
a support surface structure;
a plurality of straps coupling the U-shaped frame to the support surface structure; and
an adjustable head support coupled to the support surface structure, wherein the adjustable head support is distal from the swing circle.

2. The support system of claim 1 wherein the adjustable head support extends beyond an end of the first frame and an end of the U-shaped frame.

3. The support system of claim 1 wherein the plurality of legs can be configured to place the first frame in a Trendelenburg or a reverse-Trendelenburg position.

4. The support system of claim 1 further comprising a synchronous drive mechanism coupled to the first frame and coupled to the swing circle.

5. The support system of claim 1 wherein the swing circle comprises a hole configured to receive a locking pin that extends through the first frame and the hole in the swing circle.

6. The patient support system of claim 1 wherein a pair of the plurality of legs are configured to pivot towards the first frame.

7. The patient support system of claim 1 further comprising a removable cage coupled to the first frame.

8. A system comprising:

a first patient support system configured to support a first patient;

a second patient support system configured to support a second patient; and a rotation shaft coupling the first patient support system to the second patient support system, wherein a first rotation of the first patient support system will cause a second rotation of the second patient support system.

9. The system of claim 8, wherein the first rotation is equivalent to the second rotation.

10. The system of claim 8, wherein the first patient support system comprises a first support surface structure and the second patient support system comprises a second support surface structure.

11. The system of claim 10, wherein the first patient support system comprises a first U-shaped frame coupled to the first support surface structure and the second patient support system comprises a second U-shaped frame coupled to the second support surface structure.

12. The system of claim 11 wherein the first patient support system comprises a first swing circle coupled to the first U-shaped frame and the second patient support system comprises a second swing circle coupled to the second U-shaped frame.

13. The system of claim 12 wherein the first swing circle comprises a hole configured to receive a locking pin that extends through the hole.

* * * * *